US005439433A

United States Patent [19]

Lundin et al.

[11] Patent Number: 5,439,433

[45] Date of Patent: Aug. 8, 1995

[54] SUPPORT BAR FOR EXERCISE MACHINE

[75] Inventors: Christopher B. Lundin, Mantua, N.J.; Clive G. Stevens, Taipei, Taiwan

[73] Assignee: Physiq, Inc., Bellmawr, N.J.

[21] Appl. No.: 254,911

[22] Filed: Jun. 6, 1994

[51] Int. Cl.[6] ..... A63B 23/04

[52] U.S. Cl. ..... 482/53; 482/52

[58] Field of Search ..... 482/51, 52, 53, 142, 482/148, 133, 140, 908

[56] References Cited

U.S. PATENT DOCUMENTS 4,620,701 11/1986 Mojden ..... 482/142
4,838,543 6/1989 Armstrong et al. ..... 482/52
4,961,570 10/1990 Chang ..... 482/53

*Primary Examiner*—Stephen R. Crow
*Attorney, Agent, or Firm*—Norman E. Lehrer; Jeffrey S. Ginsberg

[57] ABSTRACT

A step climber exercise machine comprises a base frame having a support bar telescopically mounted therein, a pair of stepping members pivotally secured to the base frame, a main strut attached to the base frame extending upwardly therefrom and handle bars secured atop the main strut. A different resistance is secured to each stepping member for providing resistance when a downward force is placed on the stepping members by the user. The support bar can extend outwardly from the base frame to prevent tipping of the exercise machine when in use.

9 Claims, 5 Drawing Sheets

SUPPORT BAR FOR EXERCISE MACHINE

BACKGROUND OF THE INVENTION

The present invention is directed toward a collapsible step climber exercise machine for providing a cardiovascular workout and, more particularly, to such an exercise machine having a base frame, a pair of stepping members and handle bars wherein the step climber is collapsible for easy storage and includes a support bar to prevent tipping of the exercise machine when in use.

During the last few years step climber exercise machines have become an increasingly preferred method for obtaining a cardiovascular workout. Such machines are also used to tone and shape a person's body. One reason for this trend is the fact that step climber exercisers, commonly referred to as steppers, cause significantly less stress to the knee area than jogging and/or running. Additionally, steppers allow the user to exercise without ever leaving his or her own home.

Step climber exercisers are well known in the art. Such exercise machines are shown, for example, in prior U.S. Pat. Nos. 5,232,420 and 5,230,674. These exercisers are deficient in that they do not have handle bars or other means to allow the user to balance himself during a workout.

Furthermore, the above mentioned devices as well as other known step climbers are not designed to accommodate exercises where the user's posterior extends passed the foot supporting members. See, for example, U.S. Pat. Nos. 4,496,147 and 4,563,001. This prevents the user from tailoring a workout to concentrate certain areas of his or her body. For example, if the user wanted to concentrate on exercising the hamstring area on the back of the leg as well as the glutimus maximus area, the user would preferably have his or her posterior extend passed the foot supporting members while exercising. However, the above mentioned devices do not provide the balance required to accommodate such a position and would tip over if such exercises were attempted.

As stated above, step climber exercisers are often used in the privacy of one's home. Some known home fitness devices are foldable so that they can be stored away when not in use. A common drawback to many of these devices is that they are not readily collapsible and require significant effort to be placed in the storage position.

Accordingly, there is a need for a step climber exerciser that allows the user to perform a variety of different exercises without tipping over and is readily collapsible so that it can be stored.

Summary of the Invention

The present invention is designed to overcome the deficiencies of the prior art discussed above. It is an object of this invention to provide a device for simulation of step climbing.

It is a further object of this invention to provide a step climber exercise machine that provides the balance needed to allow the user to perform exercises where his or her posterior extends passed the foot supporting members.

It is yet another object of the invention to provide such a device that can be conveniently stored when not in use.

In accordance with the illustrative embodiments, demonstrating features and advantages of the present invention, there is provided a step climber exercise machine which comprises a base frame having a support bar telescopically mounted therein, a pair of stepping members pivotally secured to the base frame, a main strut attached to the base frame extending upwardly therefrom and handle bars secured atop the main strut. Resistance means are secured to the stepping members, for providing resistance when a downward force is placed on the stepping members by the user.

The user may simulate step climbing by repeatedly stepping up and down on the stepping members. The resistance means can be adjusted to provide a desired level of resistance.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
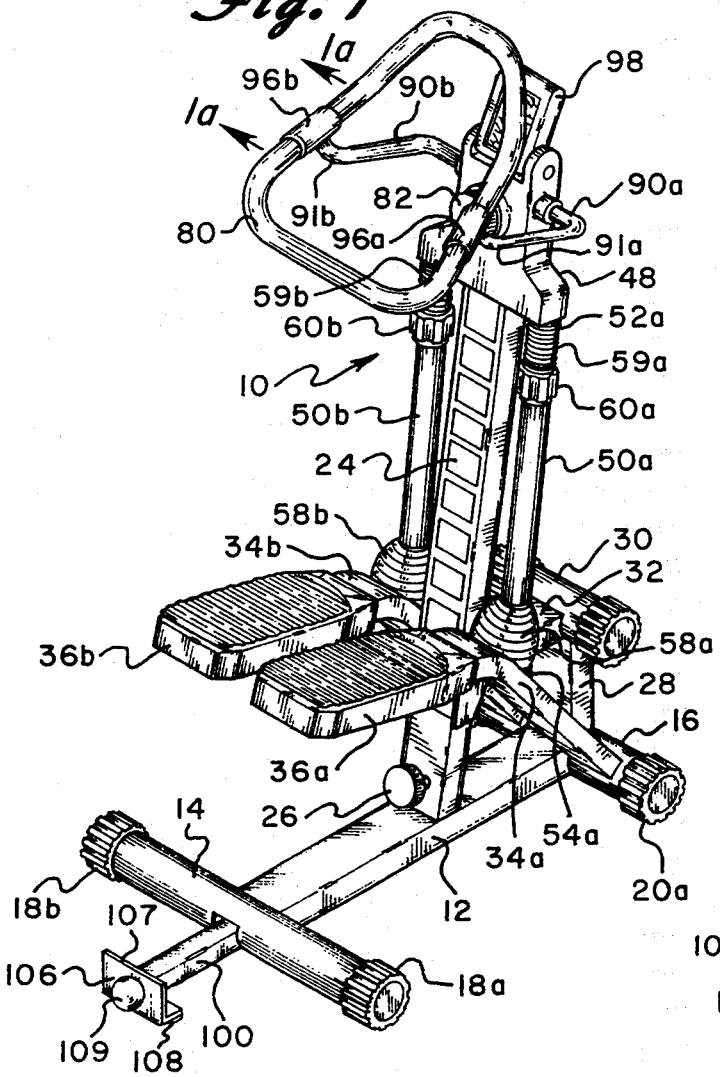
FIG. 1 is a rear perspective view of a step climber exercise machine constructed in accordance with the present invention.

Referring now to the drawings in detail wherein like reference numerals have been used throughout the various figures to designate like elements, there is shown in FIG. 1 a collapsible step climber exercise machine constructed in accordance with the principles of the present invention and designated generally as 10.

The step climber exercise machine includes a base frame having a base member 12, a transverse rear segment 14 and a transverse front segment 16. In the preferred embodiment, the rear segment 14 and the front segment 16 each include a pair of spaced apart caps, 18*a*, 18*b* and 20*a*, 20*b* respectively, that are adapted to frictionally engage the ground when the step climber is in use.

Channel member 22 is attached to the base member 12, preferably by welding the same thereto. Pivot plate 27 extends from the top of the channel member 22. Main strut 24 is partially inserted through pivot plate 27 and into channel member 22 when the exercise machine is in its operating condition (see FIGS. 3 and 6).

Figure 3:
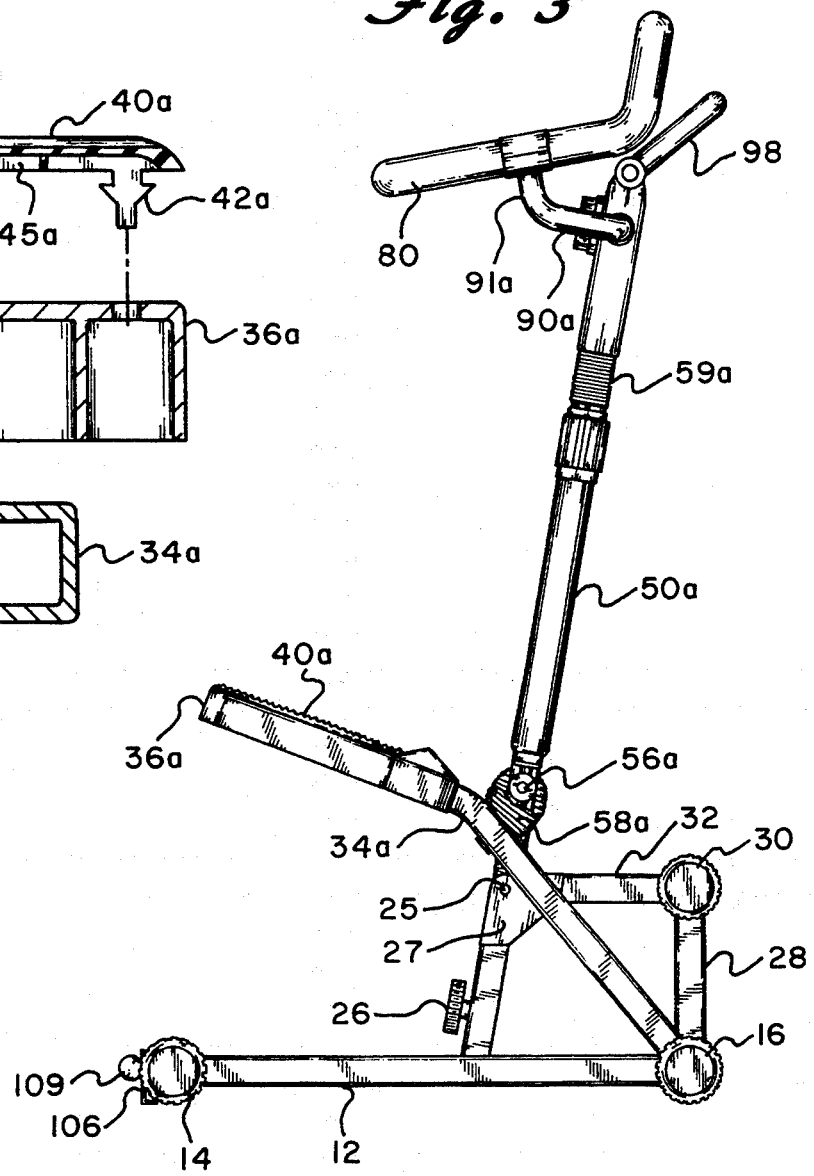
FIG. 3 is a side view of the step climber in the operating position.
Figure 6:
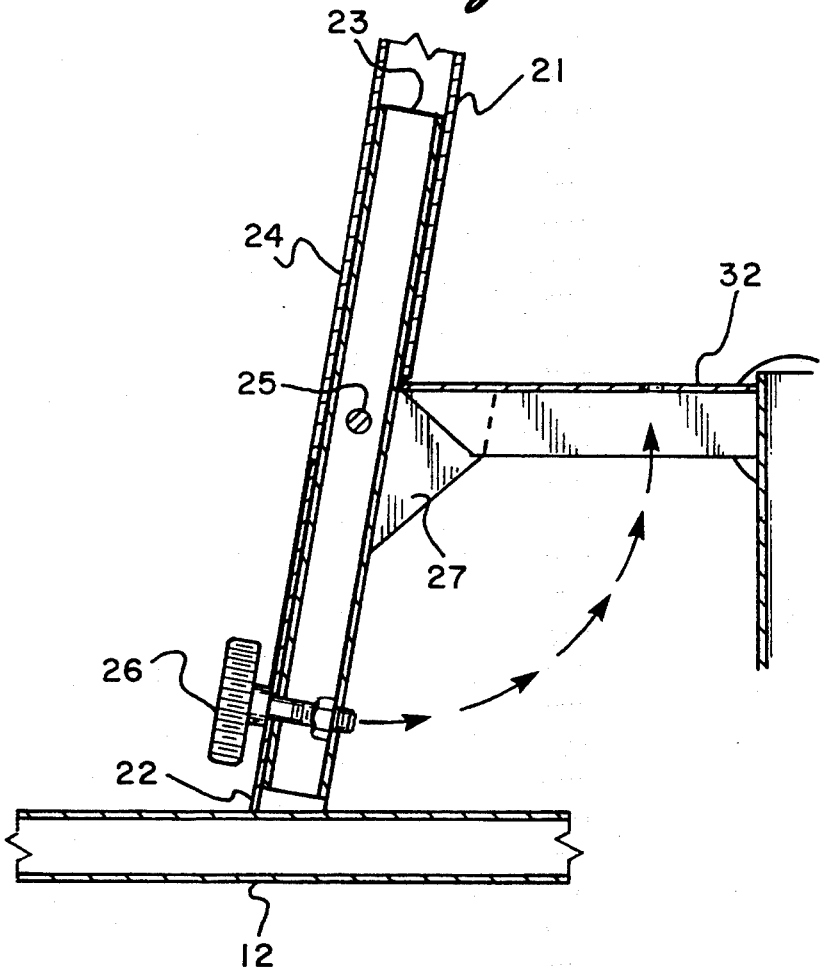
FIG. 6 is a partial cross-sectional view of the main strut raised in the operating position.

In the preferred embodiment, the main strut 24 is comprised of an outer segment 21 and an inner segment 23. The inner segment 23 is friction fit in the outer segment 21. The inner segment 23 extends from the outer segment 21 and is pivotally connected to pivot plate 27 at pivot point 25 as illustrated in FIGS. 3 and 6. Screw knob 26 secures the inner segment 23 of main strut 24 to the channel member 22 when the exercise machine is in its operating condition. In an alternate embodiment, the main strut can be one molded piece comprising a large diameter segment and a reduced diameter segment extending therefrom.

Front support 28 is secured to transverse front segment 16. Beam 30 is attached atop the front support 28. Positioned between the channel member 22 and beam 30 is horizontal housing 32. The end of the horizontal housing 32 furthest from beam 30 extends into pivot plate 27. The horizontal housing 32 has an open bottom for receiving the inner segment 23 of main strut 24 when screw knob 26 is manually removed and the step climber 10 is collapsed from its operating position to its storage position as described below.

Figure 4:
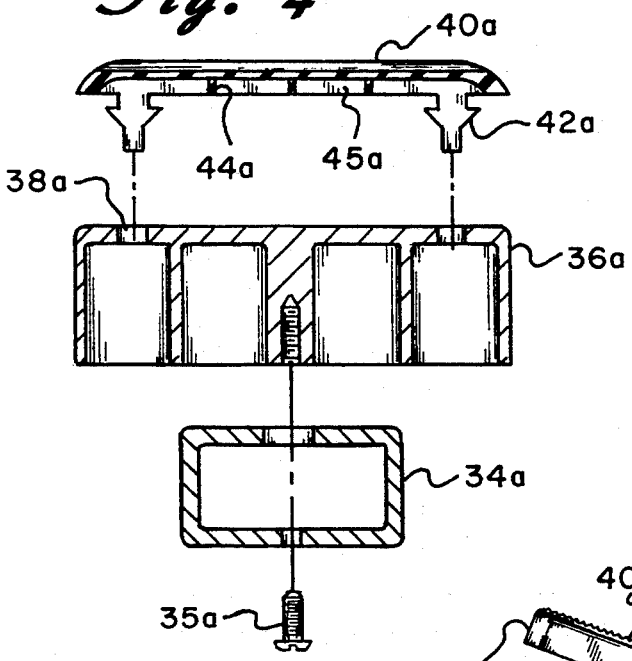
FIG. 4 is a cross-sectional view of the foot supporting segment.

Right and left laterally spaced stepping members **34*a*, 34*b* are pivotally mounted to front segment 16. The right and left stepping members 34*a*, 34*b* are substantially identical to each other. Accordingly, only one of the stepping members will be described in detail, it being understood that the description applies equally to the other stepping members. The foot supporting segment 36*a* is partially inserted over stepping member 34*a*. Screw 35*a* secures foot supporting segment 36*a* to stepping member 34*a* as shown in FIG. 4. The foot supporting segment 36*a* has a plurality of apertures 38*a*** formed therein.

Figure 5:
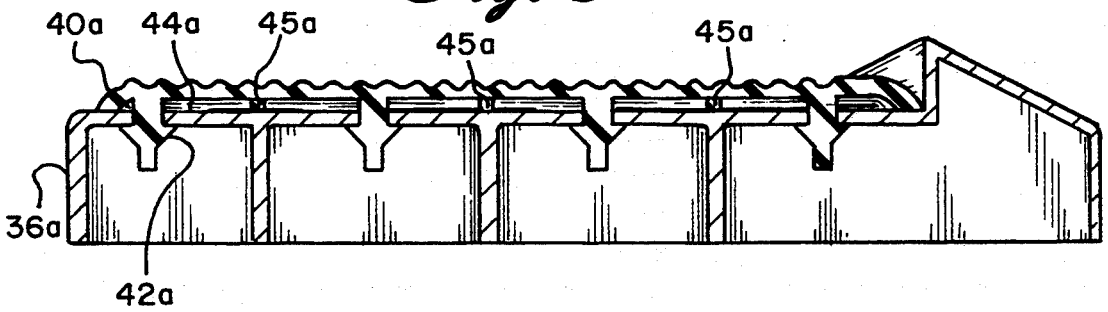
FIG. 5 is a cross-sectional side view of the foot supporting segment.

A compression mat **40*a* is secured atop foot supporting segment 36*a* by means of barbed extensions 42*a* friction fitted in the apertures 38*a*. Compression mat 40*a* has a plurality of longitudinal and latitudinal projections 44*a* and 45*a*, respectively, extending downwardly from the undersurface of the mat as shown in FIG. 5. The projections are preferably made of an elastic material such as rubber. When the user steps down on segment 36*a* the projections 44*a*, 45*a* of compression mat 40*a* are slightly compressed so that the user encounters a cushioned surface. The top side of compression mat 40*a* includes a plurality of elongated ribs 46*a*** for providing a non-slip gripping surface.

Figure 2:
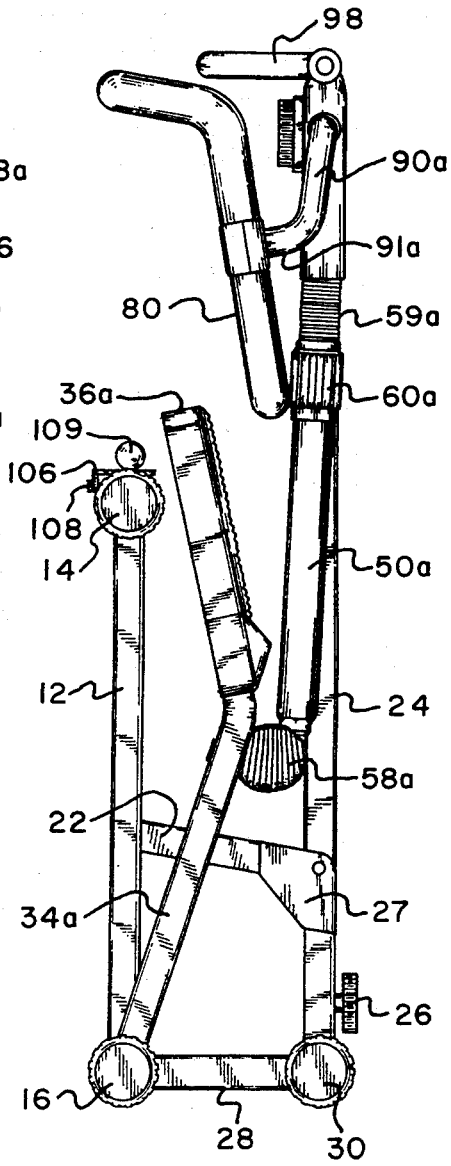
FIG. 2 is a side view of the step climber in the storage position.

Referring back to FIG. 1, upper frame 48 is secured atop main strut 24. Right and left resistance means **50*a* and 50*b* are connected to a corresponding stepping member 34*a* and 34*b* and to the upper frame 48. Again, while only one resistance means will be described in detail, it should be understood that the description equally applies to the other resistance means. Resistance means 50*a* has a top 52*a* and a bottom 54*a*. Bottom 54*a* is connected to stepping member 34*a* through the use of a double pivot joint 56*a* as shown in FIG. 3. Top 52*a* is attached to the upper frame 48. In a preferred embodiment, the resistance means 50*a* comprises a resistance cylinder and a piston rod. The resistance means 50*a* can be of the pneumatic or hydraulic type. Lower telescoping boot 58*a* surrounds the double pivot joint 56*a* as illustrated in FIGS. 1–3**.

Figure 13:
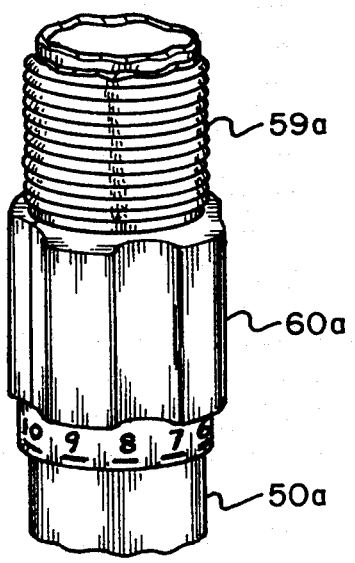
FIG. 13 is a partial view of the resistance means showing the adjustment valve and upper boot.

Similarly, upper telescoping boot **59*a* surrounds top 52*a* of resistance means 50*a* so that the piston rod (not shown) is not exposed. Adjustment valve 60*a* is secured to the resistance means 50*a* at the bottom of boot 59*a* for allowing the user to manually select a desired level of tension (see FIG. 13**).

Figure 8:
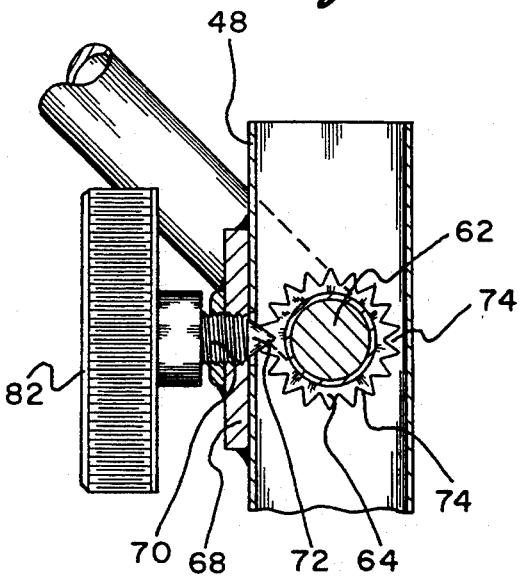
FIG. 8 is a partial side cross-sectional view of the upper frame showing the pointed screw engaged in a notch of the ratchet wheel.
Figure 9:
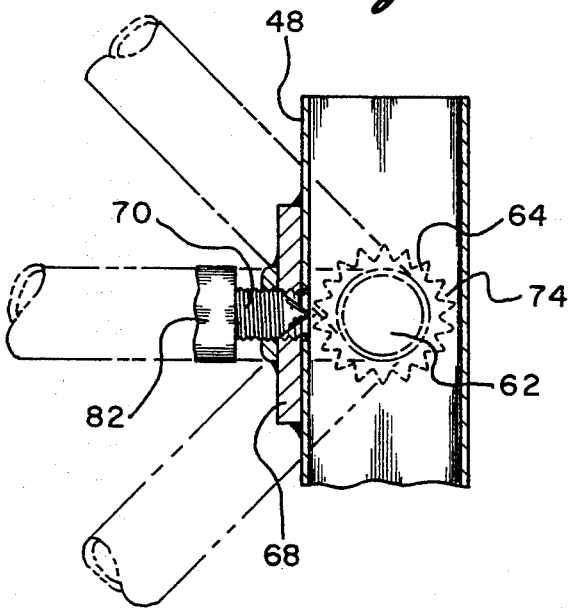
FIG. 9 is a partial side cross-sectional view of the upper frame showing the pointed screw disengaged from the ratchet wheel.
Figure 10:
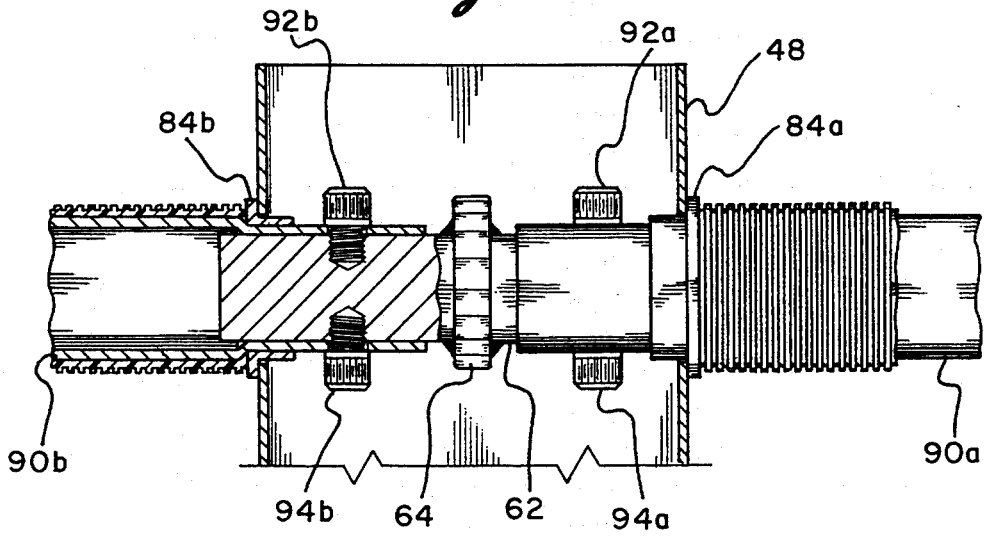
FIG. 10 is a cross-sectional view of the upper frame of the step climber.

Referring to FIGS. 8–10, axle 62 is inserted through the hub of ratchet wheel 64. The ratchet wheel 64 is secured around the center of axle 62. The axle 62 is rotatably mounted in and extends through the right and left sides of upper frame 48. A threaded support plate 68 is secured to the back of upper frame 48, preferably by welding the same thereto. A pointed screw 70 having a pointed tip 72 is threaded through support plate 68 to engage a desired notch 74 in ratchet wheel 64 for securing handlebar 80 in place. A knob 82 is secured to the end of pointed screw 70 opposite pointed tip 72 so that the user can readily disengage the screw 70 from notch 74 by turning the knob in the manner described below.

A bushing **84*a* is secured to the right side of the upper frame 48 and a bushing 84*b* is secured to the left side of upper frame 48. Right support tube 90*a* is inserted around axle 62, through bushing 84*a* and into upper frame 48. Right support tube 90*a* is secured to the axle 62 by a top screw 92*a* and a bottom screw 94*a*. Left support tube 90*b* is secured to the axle 62 in upper frame 48** in a similar manner.

Figure 1A:
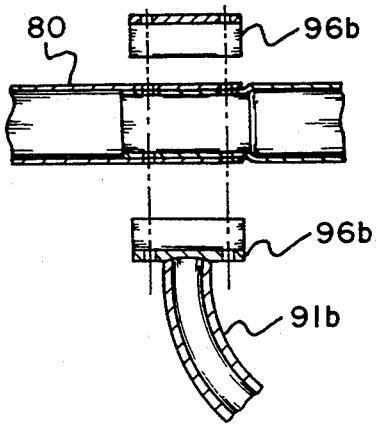
FIG. 1*a* is a cross-sectional view taken along lines 1*a*—1*a* of FIG. 1.

Right support tube **90*a* extends from the right side of upper frame 48. Similarly, left support tube 90*b* extends from the left side of upper frame 48. In the preferred embodiment, right support tube 90*a* is L-shaped and has an upwardly curved end portion 91*a* as shown in FIGS. 2 and 3. Left support tube 90*b* is similarly shaped and has an upwardly curved end portion 91*b*. Handlebar 80 is positioned atop the right and left tube ends 91*a*, 91*b*. Brackets 96*a*, 96*b* secure the tube ends to handlebar 80 (see FIG. 1*a***). The handlebar is shaped to provide both comfort and support to the user of the step climber exercise machine.

In the preferred embodiment, an adjustable display means 98 is mounted atop the upper frame 48. The display means 98 is equipped with a computer to provide the user with a variety of information such as the user's heart rate, how many calories are being burned and how much time is remaining to complete the workout.

Figure 11:
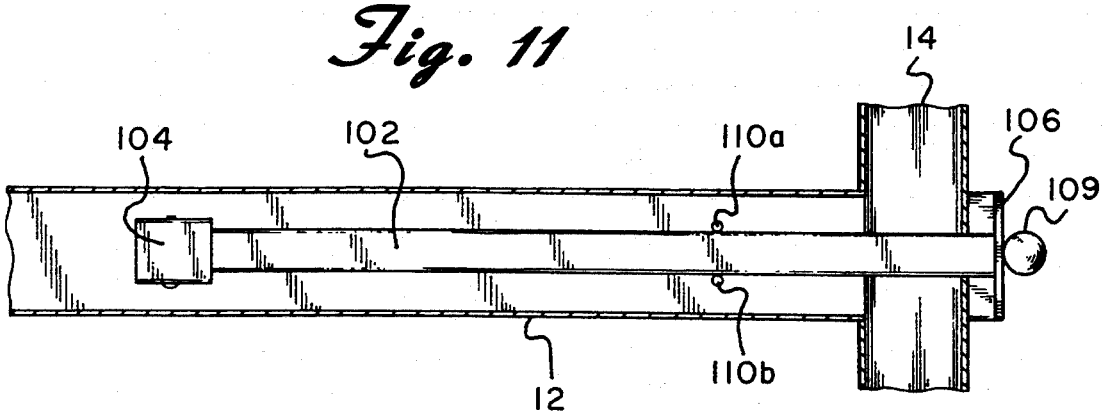
FIG. 11 is a partial cross-sectional view of the support bar telescopically mounted in the base member.
Figure 12:
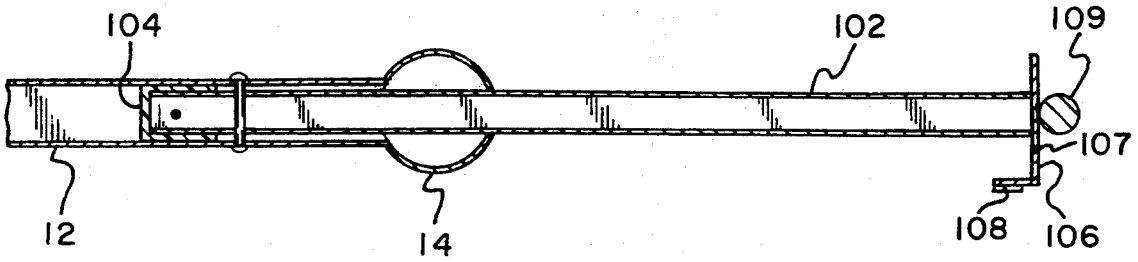
FIG. 12 is a partial side cross-sectional view of the support bar telescopically mounted in the base member.

Referring to FIGS. 11 and 12, the step climber exerciser of the present invention is designed to allow the user to perform exercises with his or her posterior extending passed the foot supporting segments **36*a*, 36*b* of stepping members 34*a*, 34*b*. This is accomplished by having a support bar 100 telescopically mounted through the transverse rear segment 14 and in the base member 12. The support bar 100 includes square tube 102 having a stop cap 104 located on one end and a balancing support 106 located at the other end. The balancing support 106 preferably has a vertical portion 107 and a horizontal portion 108. The horizontal portion enhances the stability of the step climber. A knob 109 is secured to the vertical portion 107 of the balancing support 106 for aiding in the removal of the support bar 100 from the transverse rear segment 14**.

Stop guides **110*a*, 110*b* are secured to base member 12 on both sides of square tube 102 for engaging stop cap 104. More specifically, when balancing support 106 is manually pulled away from transverse rear segment 14 a sufficient distance, stop cap 104 contacts stop guides 110***a*, 110*b* thereby preventing further removal of support bar 100 from transverse rear segment 14. When the step climber 10 is in the operating condition, support bar 100 is extended. Therefore, if the user of the step climber decides to concentrate the muscles on the back of the leg as well the glutimus maximus muscles while working out, the person is free to stick his or her posterior out passed the foot supporting segments 36*a*, 36*b* without causing the step climber to tip over. This is because the support bar 100 provides the necessary balance to prevent such an occurrence.

While the support bar 100 has been specifically described for use in conjunction with a step climber, it should be understood that the same is not limited thereto. A similar support bar can be used with other exercise machines such as a bicycle or the like which may also have a tendency to tip during use.

To facilitate an understanding of the principles associated with the foregoing apparatus, its operation will now be briefly described. Before using the stair climber, the user first pulls support bar 100 from base member 12 until stop cap 104 contacts stop guides 110*a*, 110*b* and can extend no further. The user then sets adjustment valves 60*a*, 60*b* to a desired level of resistance. To increase the resistance of foot supporting segments 36*a*, 36*b* the valves are moved toward closing.

Next, the person adjusts the handlebar 80 to a level suited to his or her particular measurements. This is accomplished by disengaging tip 72 of pointed screw 70 from notch 74 of ratchet wheel 64 by turning knob 82. The handlebar 80 is then free to rotate. Once a desired position is obtained, the knob 82 is turned in the opposite direction so that the tip 72 of pointed screw 70 engages notch 74 in ratchet wheel 64.

A person wishing to exercise steps onto foot supporting segments 36*a*, 36*b*. The user then grasps handlebar 80, which is secured to upper frame 48. He or she may begin exercising by placing downward force on the foot supporting segments 36*a*, 36*b*. The downward force on the foot supporting segments is met with directly related opposing forces from resistance means 50*a*, 50*b* respectively.

After an exercise session is completed, the step climber exercise machine can be folded up and stored away. This is accomplished by manually inserting support bar 100 through transverse rear segment 14 and into base member 12. The display means 98 is folded downward. Handlebar 80 is folded toward stepping members 34*a*, 34*b* by disengaging pointed screw 70 from notch 74 in ratchet wheel 64 so that the handlebar is free to rotate. Pointed screw 70 is then threaded back into another notch 74 in ratchet wheel 64 to secure the handlebar in place.

Figure 7:
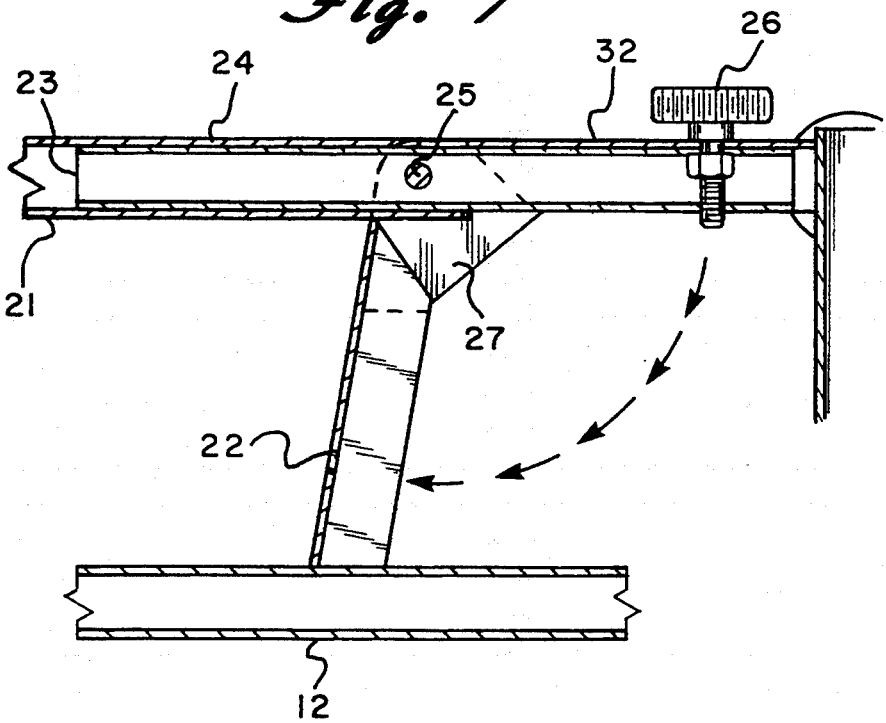
FIG. 7 is a partial cross-sectional view of the main strut shown in the storage position.

Screw knob 26 is unscrewed from the inner segment 23 of main strut 24 and channel member 22. The inner segment 23 is rotated about pivot point 25 and inserted into horizontal housing 32 (see FIGS. 6 and 7). The screw knob 26 is then threaded through the horizontal housing 32 and the inner segment 23 of main strut 24 so that the main strut is secured to the horizontal housing. The step climber is then in its storage position where it can be conveniently stored away until it is once again ready for use.

The present invention may be embodied in other specific forms without departing from the spirit or essential attributes thereof and accordingly reference should be made to the appended claims rather than to the foregoing specification as indicating the scope of the invention.

We claim:

1. A step climber exercise machine comprising:

a base frame having a longitudinally extending base member, a transverse rear segment and a transverse front segment;

a pair of laterally spaced stepping members pivotally mounted on said base frame;

resistance means having tops and bottoms, said bottom of each resistance means being pivotally attached to a different one of said stepping members for providing resistance when a downward force is placed on said stepping members;

a main strut attached to said base member between said front and rear segments, said main strut extending upwardly from said base member;

a handlebar for providing support for a person;

means for adjustably securing said handlebar to the end of said main strut furthest from said base member;

attachment means for attaching said resistance means to said upper frame, and a support bar telescopically mounted in said transverse rear segment and said base frame, said support bar being capable of extending rearwardly from said base frame and rearwardly from the center of said rear transverse segment for preventing tipping of the exercise machine when in use.

2. The exercise machine of claim 1 wherein said means for adjustably securing said handlebar to said main strut includes:

an upper frame secured atop said main strut, said upper frame having a left side and a right side;

a ratchet wheel having a hub, said ratchet wheel further having a plurality of notches;

an axle mounted through said hub of said ratchet wheel; said axle rotatably mounted in and extending through said upper frame;

a right support tube and a left support tube, said right support tube being partially inserted around said axle and extending from said right side of said upper frame, said left support tube being partially inserted around said axle and extending from said left side of said upper frame, said handlebar being attached atop said right and left support tubes, and a pointed screw having a pointed tip threaded through said upper frame, said pointed tip being engageable with one of said notches of said ratchet wheel for securing said handlebar in a predetermined position.

3. The exercise machine of claim 1 further comprising an adjustable display means mounted atop said main strut.

4. The exercise machine of claim 1 wherein said support bar includes a stop means located adjacent one end for preventing the complete removal of said support bar from said base frame.

5. The exercise machine of claim 4 further including a balancing support located at the end of said support bar opposite said stop means, said balancing support including a vertical portion and a horizontal portion, said horizontal portion being positioned below said support bar for engagement with the ground.

6. The exercise machine of claim 5 further including a handle secured to said vertical portion of said balancing support for aiding in the removal of said support bar from said transverse rear segment.

7. The exercise machine of claim 1 wherein said means for adjustably securing said handlebar to said main strut includes:

an upper frame secured atop said main strut, said upper frame having a left and a right side;

an axle rotatably mounted in and extending through said upper frame, said handlebar being attached to and movable with said axle.

8. In an exercise machine of the type having a base frame and means for supporting a person's feet while a person is standing thereon, wherein the improvement comprises a support bar telescopically mounted in said base frame and a balancing support secured to one end of said support bar, said support bar being capable of extending rearwardly from said base frame for preventing tipping of the exercise machine when in use, said support bar having a stop means secured adjacent to the end furthest from said balancing support for preventing complete removal of said support bar from said base frame, said balancing support including a vertical portion and a horizontal portion, said horizontal portion extending below said support bar for enhancing the stability of said exercise machine.

9. The exercise machine of claim 8 further including a handle secured to said vertical portion of said balancing support for aiding in the removal of said support bar from said base member.

* * * * *